US007938554B2

(12) United States Patent
Franks

(10) Patent No.: US 7,938,554 B2
(45) Date of Patent: May 10, 2011

(54) ARTIFICIAL PUMPKIN STEM

(76) Inventor: Leonard D. Franks, Warren, MI (US)

( * ) Notice: Subject to any disclaimer, the term of this patent is extended or adjusted under 35 U.S.C. 154(b) by 100 days.

(21) Appl. No.: 11/942,028

(22) Filed: Nov. 19, 2007

(65) Prior Publication Data

US 2008/0123326 A1 May 29, 2008

Related U.S. Application Data

(60) Provisional application No. 60/867,232, filed on Nov. 27, 2006.

(51) Int. Cl.

| | |
|---|---|
| ***F21S 6/00*** | (2006.01) |
| ***A41G 1/00*** | (2006.01) |
| ***A63H 33/26*** | (2006.01) |

(52) U.S. Cl. ..... 362/122; 362/567; 446/485

(58) Field of Classification Search ..... 362/565, 362/567, 122, 806; 446/485
See application file for complete search history.

(56) References Cited

U.S. PATENT DOCUMENTS

| | | | | |
|---|---|---|---|---|
| 6,513,945 | B1 | 2/2003 | Wyss et al. | |
| 6,540,371 | B2 | 4/2003 | Franks | |
| 2003/0179590 | A1 * | 9/2003 | Wyss | 362/565 |
| 2005/0174784 | A1 * | 8/2005 | Conrey | 362/431 |
| 2007/0008718 | A1 * | 1/2007 | Cayton | 362/186 |
| 2008/0105817 | A1 * | 5/2008 | Damman | 248/684 |

* cited by examiner

*Primary Examiner* — Jong-Suk (James) Lee
*Assistant Examiner* — David R Crowe
(74) *Attorney, Agent, or Firm* — Gifford, Krass, Sprinkle, Anderson & Citkowski, P.C.

(57) ABSTRACT

An artificial pumpkin stem apparatus including a stem portion. A lighting device is associated with the stem portion. The stem portion allows transmission of light from the lighting device into the stem portion wherein the stem portion emits light.

12 Claims, 5 Drawing Sheets

ARTIFICIAL PUMPKIN STEM

FIELD OF THE INVENTION

The invention relates to artificial pumpkin stems.

BACKGROUND OF THE INVENTION

Pumpkins are often carved in association with the celebration of Halloween within the United States. A common problem associated with carving pumpkins includes having the stem break off thereby, making removal of a carved lid more difficult. The use of an artificial stem that would not break off when the stem is grasped would thereby alleviate this problem.

Also, carved pumpkins or Jack-O-Lanterns are often illuminated using a candle or other such illumination means. Candles can pose fire risks, as well as, contaminate the flesh of the pumpkin. Such contamination would not allow the pumpkin to be utilized for food purposes or consumption after it has been displayed. Additionally, it is a problem known in the art that lighting from the bottom of a pumpkin may not be as appealing as lighting directed from the top downwards. Therefore, a light that could be associated with an artificial stem portion that would not sit on the bottom of the pumpkin, but would rather be associated with the carved lid and illuminate downwardly would be advantageous.

There is also a need in the art for a pumpkin stem that may be decorative or provide a secondary source of illumination to add to the display and aesthetic appearance of a carved pumpkin. Similarly, there is also a need in the art for a pumpkin stem that may produce audio responses that add to the overall effect of a carved pumpkin.

SUMMARY OF THE INVENTION

In one aspect there is disclosed an artificial pumpkin stem apparatus including a stem portion. A lighting device is associated with the stem portion. The stem portion allows transmission of light from the lighting device into the stem portion wherein the stem portion emits light.

In a second aspect there is disclosed an artificial pumpkin stem apparatus including a stem portion. A lighting device is associated with the stem portion. The lighting device includes a first lighting portion distributing light into the stem portion and a second lighting portion distributing light into an interior of a pumpkin. The stem portion allows transmission of light from the lighting device into the stem portion wherein the stem portion emits light.

In a third aspect there is disclosed an artificial pumpkin stem apparatus including a stem portion having an ornamental design formed of a light transmitting material. A lighting device is associated with the stem portion. The stem portion allows transmission of light from the lighting device into the stem portion wherein the stem portion emits light.

DETAILED DESCRIPTION OF THE PREFERRED EMBODIMENTS

Figure 4:
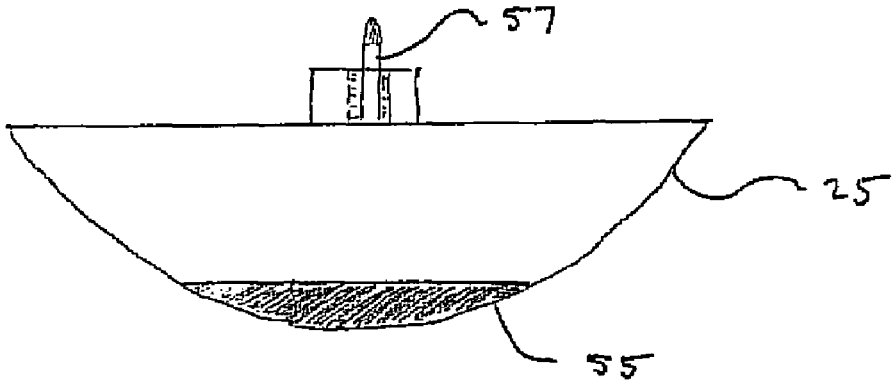
FIG. 4 is a plan view of one embodiment of an attachment plate for the artificial pumpkin stem.
Figure 1:
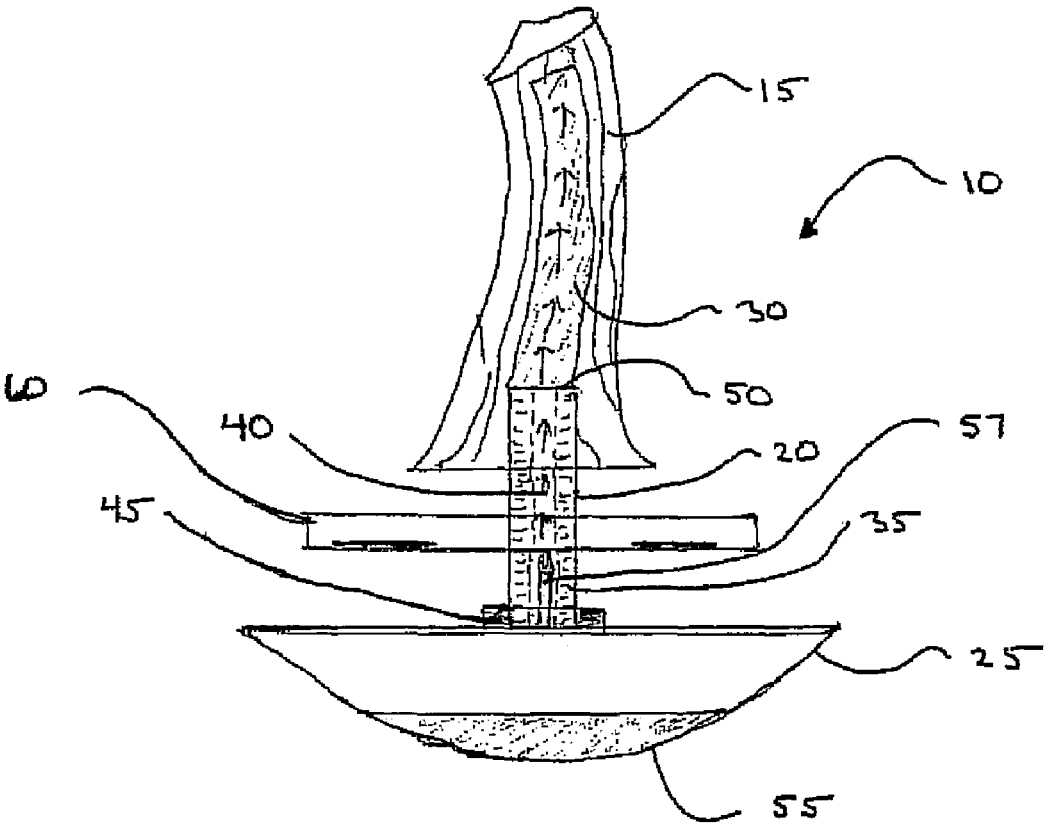
FIG. 1 is a side view of one embodiment of an artificial pumpkin stem assembly.
Figure 2:
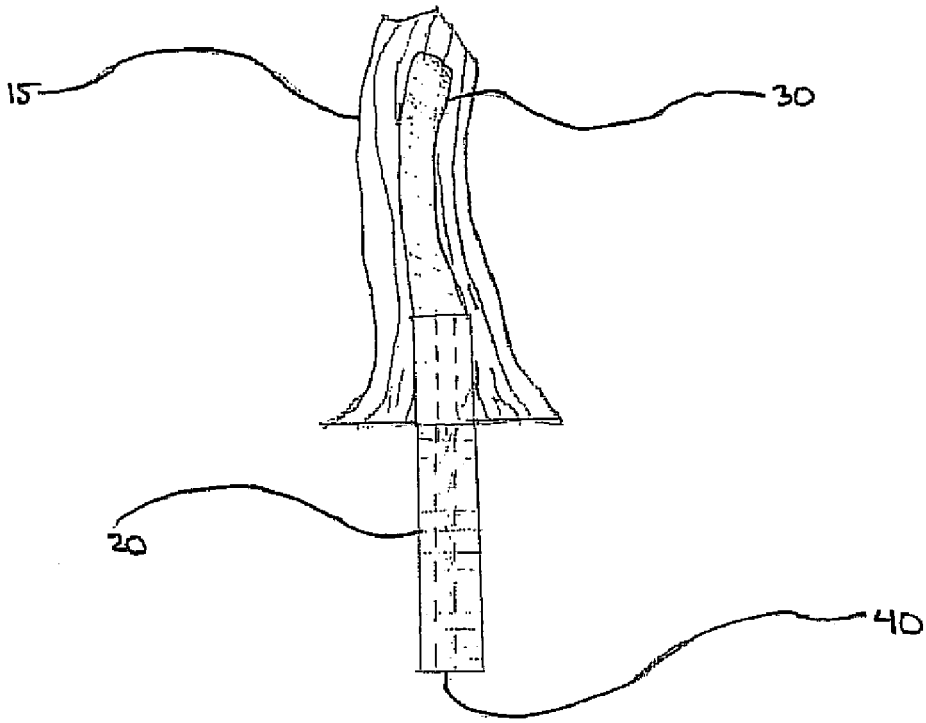
FIG. 2 is a side view of a stem portion.

Referring to FIG. 1, there is shown one embodiment of an artificial pumpkin stem apparatus 10 for detachable connection to a carved pumpkin. The artificial pumpkin stem apparatus 10 includes a stem portion 15, a shank 20, and a lighting device 25.

The stem portion 15 may be formed of various materials that transmit or project light. Suitable materials include transparent plastics and resins that allow for the transmission of light. The stem portion 15 includes a light transmitting portion 30 disposed within an interior of the stem portion 15. The light transmitting portion 30 may be formed of a suitable material that acts as a light guide to transmit light emitted from the lighting device 25, as will be described in more detail below. The light transmitting portion 30 may be formed of a suitable light transmissive material and is associated with the shank 20.

The shank 20 may extend downward as shown in the figure from the stem portion 15 and may include threads 35 formed on an outer circumference, as depicted in FIG. 1. The shank 20 may also include a light cavity 40 formed therein that extends along the longitudinal axis of the shank 20. The light cavity 40 extends from a first end 45 of the shank 20 to a second end 50 of the shank 20. The second end 50 of the shank 20 is associated with the light transmitting portion 30 disposed within an interior of the stem portion 15. The lighting device 25 may be positioned proximate the first end 45 of the shank 20 to transmit light through the light cavity 40 into the light transmission portion 30 such that the stem portion 15 emits light when the lighting device 25 is energized.

The lighting device 25 disposed at the first end 45 of the shank 20 may further include a second light producing portion 55 that distributes light in an opposing downward direction for lighting the interior of a pumpkin. It should be realized that various types of lighting devices may be used. For example, in a preferred aspect LEDs or light emitting diodes of various colors may be utilized. Light emitting diodes require small amounts of power for generating light as well as have long service lives before needing replacement. Additionally, other light producing members 57 such as incandescent bulbs, fluorescent bulbs or other light generating devices including fiber optics and light guides may be utilized to transmit light through the light cavity 40 in the shank 20 into the stem portion 15. The second light producing portion 55 may also utilize LEDs or other incandescent, fluorescent or other lighting members.

Figure 3:
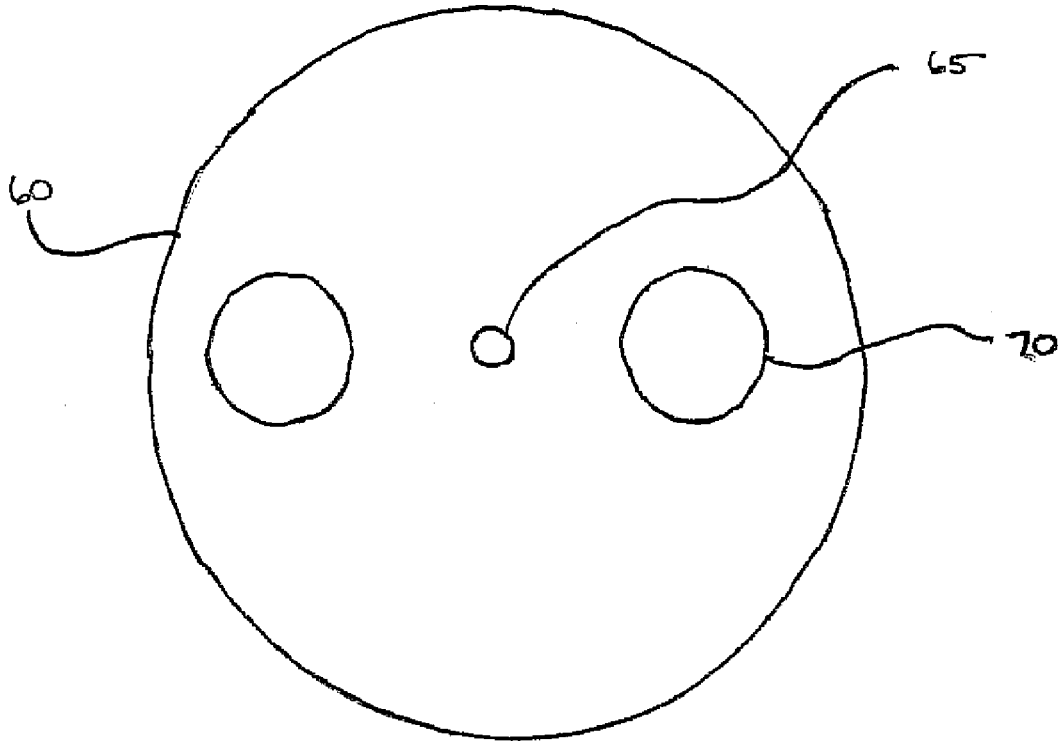
FIG. 3 is a side view of one embodiment of a light associated with the artificial pumpkin stem.

As stated previously, the shank 20 may include threads 35 formed on an outer circumference. In one aspect, a mounting plate 60 may threadably engage the shank 20 to attach the stem portion 15 and shank 20 to the top of a pumpkin. The mounting plate 60 may be a substantially planar body that may be made of any suitable material including metal or plastic. In the depicted embodiment of FIGS. 1 and 3, the mounting plate 60 includes a shaft-engaging portion 65 to engage the shank 20 as the mounting plate 60 is threaded or tightened into position. The shaft-engaging portion 65 may be a threaded hole formed in the mounting plate 60 or can include various nuts or attachment members attached to the mounting plate 60. The mounting plate 60 may include depressions or countersunk holes 70 to allow a user to grip the mounting plate 60 when threading it onto the shank 20. In an alternative aspect, the depressions or countersunk holes 70 may be replaced with tabs or other projections again to allow a user to tighten or rotate the mounting plate 60 when it is positioned about the shank 20.

Figure 5:
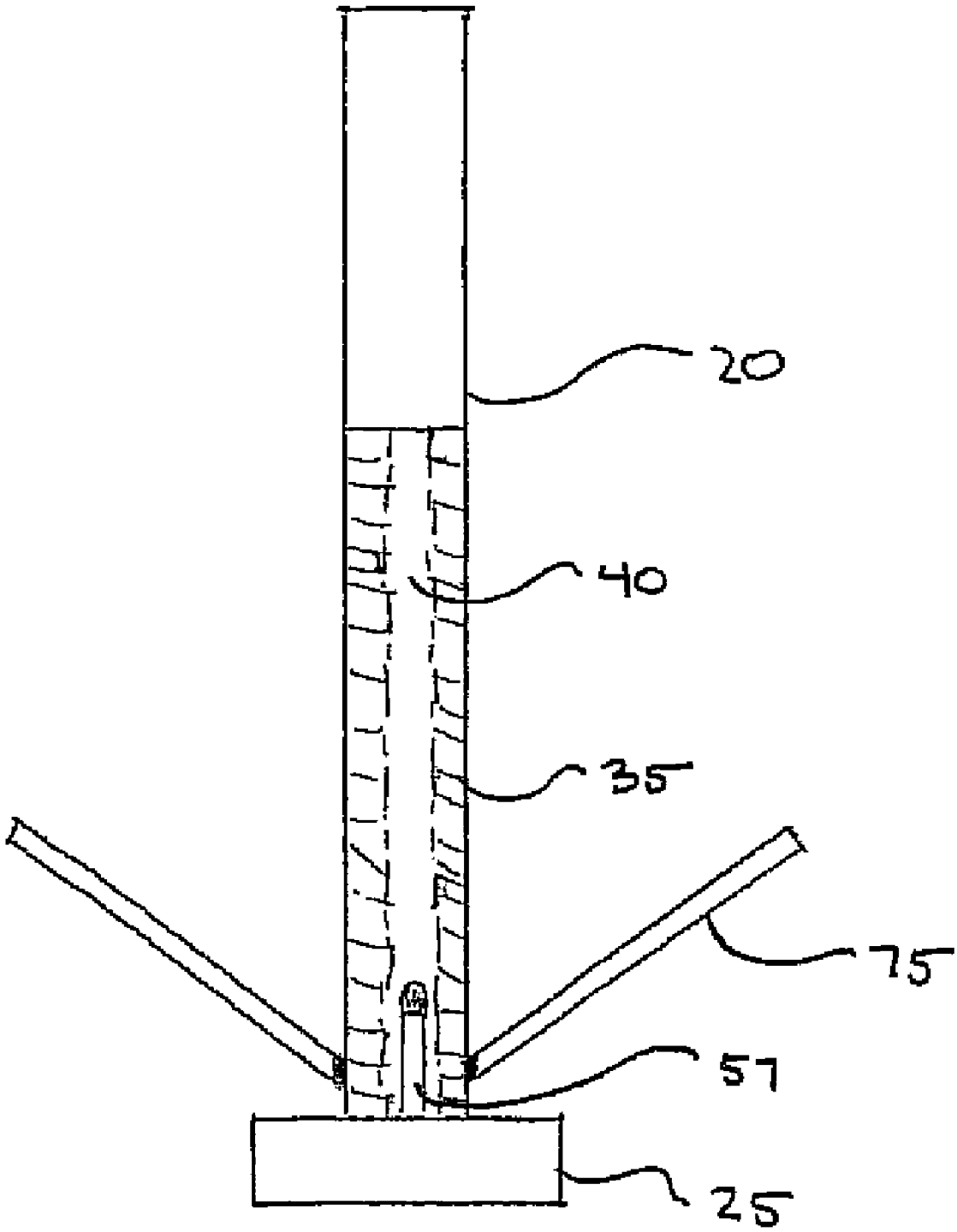
FIG. 5 is a side view of an alternative embodiment of a shank for an artificial pumpkin stem.

Referring to FIG. 5, there is shown an alternative embodiment of a shank 20 associated with an artificial pumpkin stem 15. As with the previously described embodiment, the shank 20 may include threads 35 or may be nonthreaded about an outer circumference of the shank 20. Additionally, the hollow light cavity 40 is formed through the shank 20 allowing for projection of light through the shank 20 to the light transmitting portion 30 disposed within an interior of the stem portion 15. The lighting device 25 in the depicted embodiment that is associated with the first end 45 of the shank 20 includes only one lighting device 25 that transmits light through the light cavity 40 of the shank 20 into the stem portion 15. However, it should be realized that alternative lighting devices 25 such as that shown in FIG. 1 may also be utilized.

The embodiment shown in FIG. 5 also includes a pop-out barb fastening member 75 that may be mechanical or spring loaded and extends radially outward from the shank 20 to fasten the artificial pumpkin stem 10 to a top or lid of a pumpkin.

Figure 6:
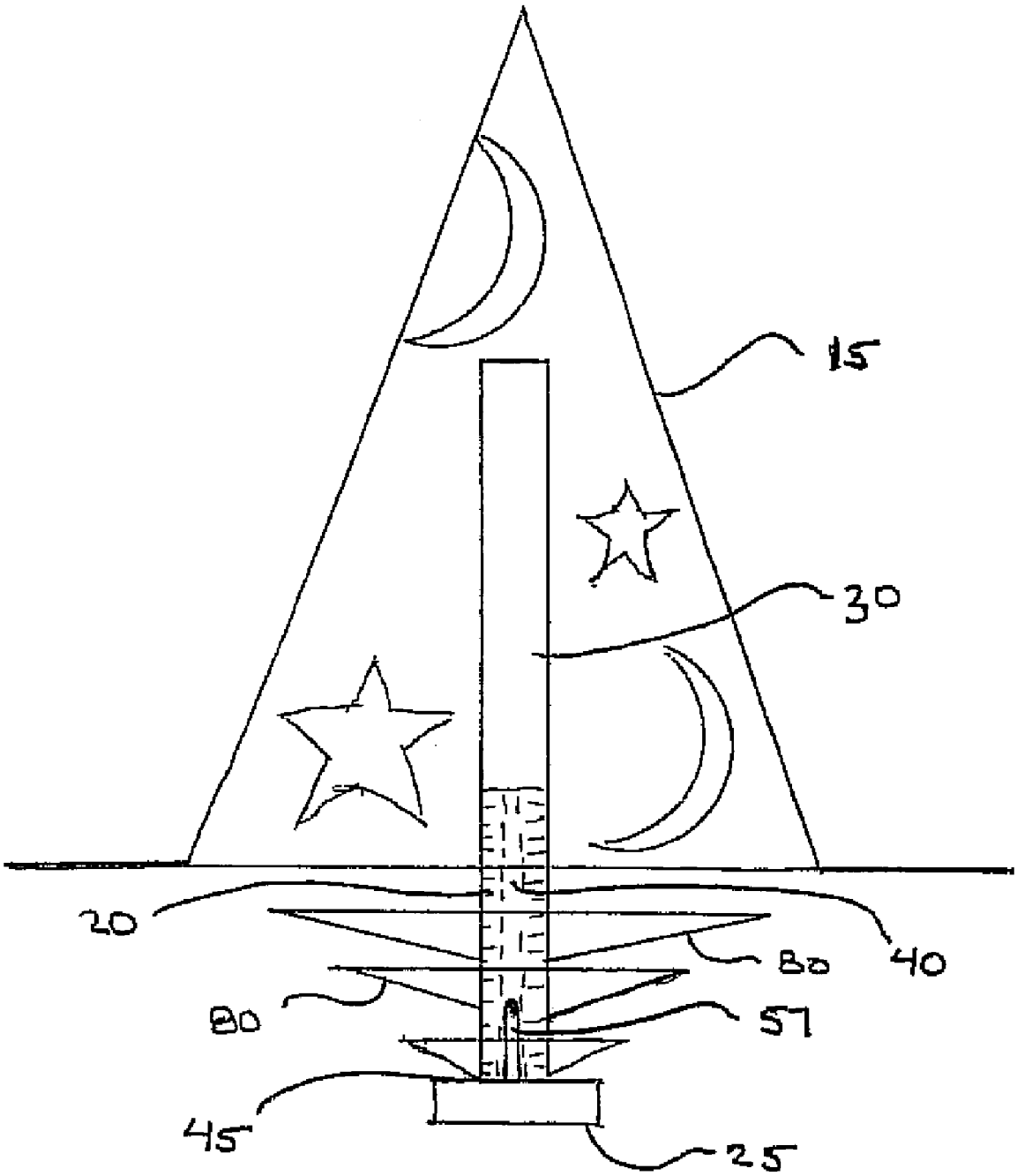
FIG. 6 is a side view of an alternative embodiment of a shank and decorative top for an artificial pumpkin stem.

Referring to FIG. 6, there is shown another alternative embodiment of a shank 20 and stem portion 15. In the depicted embodiment of FIG. 6, the shank 20 also includes the hollow cavity 40 and light transmitting portion 30 as previously described above. Additionally, a lighting device 25 is positioned at a first end 45 of the shank 20 to transmit light through the cavity 40 and into the light transmitting portion 30. However, the shank 20 in the embodiment depicted in FIG. 6 includes attachment members 80 projecting radially outward from the shank 20 and angled such that they may be pushed through the lid of a pumpkin but resist being pulled out from the lid. Such Christmas tree attachment members extend radially outward from the shank along the longitudinal axis of the shank 20. Alternatively, the attachment members 80 may be positioned on an outer rim of the bottom of the stem portion 15 such that the shank 20 may be eliminated. In such an embodiment, the lighting device 25 may also be attached directly to the stem portion 15. In such an embodiment the lighting device 25 may be associated with the light transmitting portion 30 or may be associated with the stem portion 15.

Also in FIG. 6, there is shown an alternative embodiment of a stem portion 15. The stem portion 15 depicted in FIG. 6 includes an ornamental design in the shape of a triangular hat and includes the light transmitting portion 30 disposed within an interior, as described above. It should be realized that various shapes and objects or characters may be utilized as a stem portion 15. For example, various characters such as a witch, ghost or other entity as well as various cartoon characters or logos may be used in an ornamental design. As with the previously described embodiments, the stem portion 15 is preferably formed of a light transmitting material to allow for light transmitted from the lighting device 25 through the shank 20 to be dispersed or emitted out of the stem portion 15.

Figure 7:
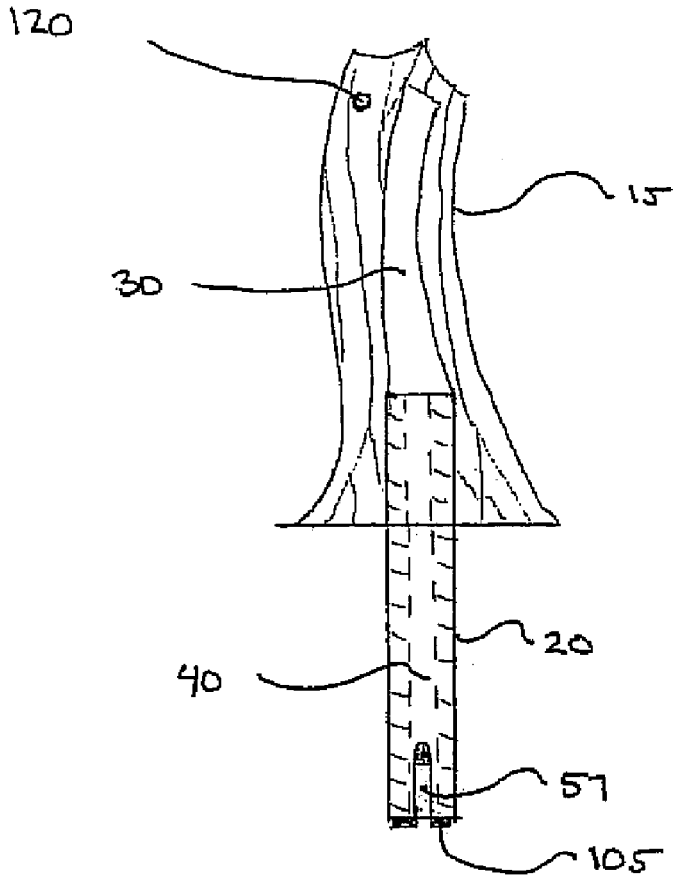
FIG. 7 is a side view of an alternative embodiment of a stem portion and shank for an artificial pumpkin stem.
Figure 8:
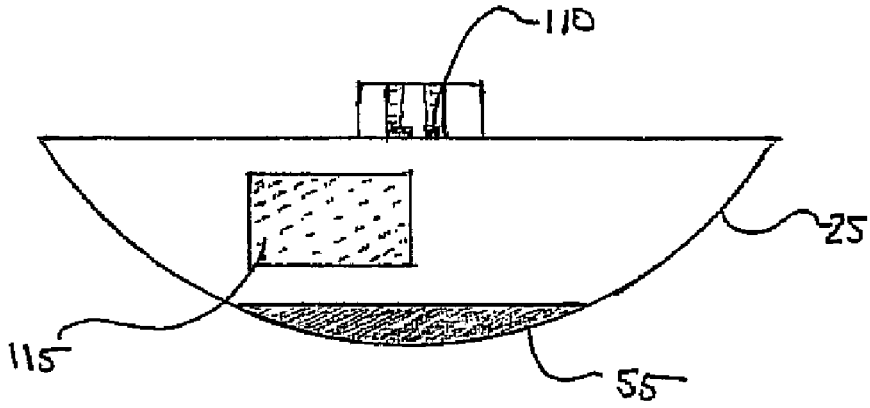
FIG. 8 is an alternative embodiment of a lighting device for an artificial pumpkin stem.

Referring to FIG. 7, there is shown an alternative embodiment of a stem portion 15 and shank 20. In the depicted embodiment, the shank 20 includes a lighting member 57 positioned in the light cavity 40 of the shank 20. The lighting member 57 may be an LED having a contact 105. The contact 105 may be mated with a corresponding contact 110 of the lighting device 25 shown in FIG. 8.

In another aspect, the lighting device 25 may include an audio member 115 producing a sound. The audio member 115 may also be positioned on the stem portion 15. Additionally, a motion sensor 120 may be positioned on the stem portion and be linked with the lighting device 25 or audio member 115 to activate the lighting device 25 or audio member 115.

While various types of lighting devices 25 have been described, it should be realized that the lighting device may include an LED, light bulb, fiber optics, light guides or other light transmitting devices may be utilized. Additionally the lighting device 25 may be attached at the first end 45 of the shank 20 utilizing any suitable attachment mechanism. For example, the lighting device 25 may be screwed onto the shank 20 or otherwise attached using fasteners or adhesive. In another aspect, the shank 20 may include a battery and suitable wire connection when the lighting device 25 is associated with the stem portion 15.

The invention has been described in an illustrative manner. It is to be understood that the terminology which has been used is intended to be in the nature of words of description, rather than limitation. Many modifications and variations of the invention are possible in light of the above teachings. Therefore, within the scope of the appended claims, the invention may be practiced other than as specifically described.

I claim:

1. An artificial pumpkin stem apparatus comprising:

a stem portion having an ornamental design formed of a light transmitting material;

a lighting device optically coupled with the stem portion;

the stem portion allowing transmission of light from the lighting device into the stem portion wherein the stem portion emits light; and a shank connected between the lighting device and the stem portion, the shank including a light cavity through which light from the lighting device is directed into the stem portion.

2. The artificial pumpkin stem of claim 1 wherein the light cavity extends along a longitudinal axis of the shank, the light cavity associated with the stem portion at one end and with the lighting device at another end.

3. The artificial pumpkin stem of claim 1 wherein the lighting device includes a first lighting portion distributing light into the stem portion and a second lighting portion distributing light into an interior of a pumpkin.

4. The artificial pumpkin stem of claim 1 wherein the lighting device includes light members selected from the group consisting of: light emitting diodes, incandescent bulbs, and fluorescent bulbs.

5. The artificial pumpkin stem of claim 1 wherein the lighting device includes fiber optic members or light guides transmitting light to the stem portion.

6. The artificial pumpkin stem of claim 1 wherein the shank includes threads formed on an outer circumference of the shank.

7. The artificial pumpkin stem of claim 6 including a mounting plate threadably moveable on the shank for contacting a lid of a pumpkin.

8. The artificial pumpkin stem of claim 1 wherein the shank includes a moveable barb member extending radially from the shank for fastening the artificial pumpkin stem to a lid of a pumpkin.

9. The artificial pumpkin stem of claim 1 wherein the shank includes attachment members projecting radially outward from the shank and angled to resist extraction from a lid of a pumpkin.

10. The artificial pumpkin stein of claim 1 including a motion sensor linked with the lighting device to activate the lighting device.

11. The artificial pumpkin stem of claim 1 including an audio member associated with the stem portion or lighting device producing a sound.

12. The artificial pumpkin stem of claim 1 wherein the shank includes a light member attached thereto, the light member including a contact that mates with a contact formed on the lighting device.

* * * * *

UNITED STATES PATENT AND TRADEMARK OFFICE

CERTIFICATE OF CORRECTION

PATENT NO. : 7,938,554 B2
APPLICATION NO. : 11/942028
DATED : May 10, 2011
INVENTOR(S) : Leonard D. Franks It is certified that error appears in the above-identified patent and that said Letters Patent is hereby corrected as shown below:

Col. 5, line 1: change ~~stein~~ to --stem--.

Signed and Sealed this
Fifth Day of July, 2011

David J. Kappos

David J. Kappos
*Director of the United States Patent and Trademark Office*